US010188957B2

(12) United States Patent
Teel et al.

(10) Patent No.: US 10,188,957 B2
(45) Date of Patent: Jan. 29, 2019

(54) TOY WITH PROXIMITY-BASED INTERACTIVE FEATURES

(71) Applicant: Mattel, Inc., El Segundo, CA (US)

(72) Inventors: Peter E. Teel, Los Angeles, CA (US); Scott E. Wilger, Redondo Beach, CA (US); Kenny Y. W. Lui, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 89 days.

(21) Appl. No.: 15/296,554

(22) Filed: Oct. 18, 2016

(65) Prior Publication Data

US 2018/0104605 A1 Apr. 19, 2018

(51) Int. Cl.

| | |
|---|---|
| ***A63H 3/28*** | (2006.01) |
| ***A63H 3/00*** | (2006.01) |
| ***A63H 3/04*** | (2006.01) |

(52) U.S. Cl.

CPC ..... *A63H 3/28* (2013.01); *A63H 3/006* (2013.01); *A63H 3/04* (2013.01); *A63H 2200/00* (2013.01)

(58) Field of Classification Search

None

See application file for complete search history.

(56) References Cited

U.S. PATENT DOCUMENTS

| | | | |
|---|---|---|---|
| 3,274,729 | A | 9/1966 | Claude |
| 4,272,916 | A | 6/1981 | Giordano |
| 4,479,329 | A | 10/1984 | Fraden |
| 4,659,919 | A | 4/1987 | Price |
| 4,675,519 | A | 6/1987 | Price |
| 4,717,363 | A | 1/1988 | Refabert |
| 4,757,491 | A | 7/1988 | Koike |
| 5,373,096 | A | 12/1994 | Suzuki |
| 5,413,518 | A | 5/1995 | Lin |
| 5,501,627 | A | 3/1996 | Ekstein |
| 6,273,421 | B1 | 8/2001 | Thalheimer |
| 6,592,422 | B1 | 7/2003 | Rehkemper |
| 6,685,530 | B1 | 2/2004 | Rehkemper |
| 6,695,672 | B1 | 2/2004 | Rehkemper |
| 6,997,772 | B2 | 2/2006 | Fong |
| 7,364,488 | B2 | 4/2008 | Mueller |
| 7,429,931 | B2 | 9/2008 | Severson |
| 7,804,417 | B2 | 9/2010 | Fujikawa |
| 7,939,742 | B2 | 5/2011 | Glaser |
| 7,942,720 | B1 | 5/2011 | Galoustian |
| 8,093,483 | B2 | 1/2012 | Dancer |

(Continued)

FOREIGN PATENT DOCUMENTS

| | | | |
|---|---|---|---|
| JP | 2004086118 | A | 3/2004 |
| JP | 2005037758 | A | 2/2005 |

(Continued)

*Primary Examiner* — Jay Liddle

*Assistant Examiner* — Alex F. R. P. Rada, III

(74) *Attorney, Agent, or Firm* — Edell, Shapiro & Finnan, LLC

(57) ABSTRACT

Presented herein are techniques in which the proximity of an object to a toy is determined using a photosensor (photo sensor) circuit. The proximity is classified/categorized as falling into one of a plurality of different proximity ranges. The proximity range in which the object is located is mapped to one or more audible or visual outputs, where the audible or visual outputs are adjusted/varied as the relative proximity of the object to the toy changes.

20 Claims, 6 Drawing Sheets

(56) References Cited

U.S. PATENT DOCUMENTS

| | | | | |
|---|---|---|---|---|
| 8,697,977 | B1 | 4/2014 | Lysaght | |
| 8,718,823 | B2 | 5/2014 | Tsujino | |
| 8,796,529 | B2 | 8/2014 | Butera | |
| 2004/0043696 | A1 | 3/2004 | Suzuki | |
| 2007/0008726 | A1 | 1/2007 | Brown | |
| 2008/0305709 | A1 | 12/2008 | Chan | |
| 2009/0311941 | A1* | 12/2009 | Bickerton | A63H 11/02 446/3 |
| 2012/0052765 | A1* | 3/2012 | Cannon | A63H 3/003 446/397 |
| 2015/0186702 | A1 | 7/2015 | Pletcher | |

FOREIGN PATENT DOCUMENTS

| | | | |
|---|---|---|---|
| JP | 2007155946 | A | 6/2007 |
| WO | 2009007512 | A1 | 1/2009 |
| WO | 2011102744 | A1 | 8/2011 |

* cited by examiner 108
114
106
104
101
102

108
114
112
124
110
101
102

108
114
106
112
110
104
101
102

325

326(A)
316(1)
327
326(I)
326(B)
316(2)
326(H)
326(C)
316(3)
326(G)
316(4)
326(D)
326(F)
316(5)
326(E)
102
106

316(1)
317(1)
316(2)
317(2)
316(3)
317(3)
316(4)
317(4)
316(5)
317(5)
0
Light Intensity Received By Toy Figure
Proximity 316(1)
318(1)
316(2)
318(2)
316(3)
318(3)
316(4)
318(4)
316(5)
318(5)
0
Light Intensity Produced From Toy Figure
Proximity

170

TOY WITH PROXIMITY-BASED INTERACTIVE FEATURES

TECHNICAL FIELD

The present disclosure relates to a toy with proximity-based interactive features.

BACKGROUND

Children and adults enjoy a variety of toy figures (figurines), such as action figures and dolls, which can be manipulated to simulate real life and fantastical activities. As such, toy figures often provide entertainment, enhance cognitive behavior, and stimulate creativity. One way of increasing the available play options is to provide toy figures capable of interacting with a user (e.g., a child).

BRIEF DESCRIPTION OF THE DRAWINGS

Like reference numerals have been used to identify like elements throughout this disclosure.

DESCRIPTION OF EXAMPLE EMBODIMENTS

Presented herein are techniques associated with an interactive toy, such as a toy figure, that produces different (variable) audible, visual, mechanical, or other outputs based on the proximity of an object to the toy. In particular, the proximity of the object to the toy is determined using a photosensor (photo sensor) circuit and the proximity is classified/categorized as falling into one of a plurality of different proximity ranges. The proximity range in which the object is located is mapped to one or more audible or visual outputs, where the audible or visual outputs are adjusted/varied as the relative proximity of the object to the toy changes.

The embodiments presented herein may be used in a number of different types of toys or other devices/systems. However, merely for ease of illustration, the embodiments of the present invention will be generally described with reference to a toy figure (e.g., action figure, doll, etc.).

Figures 1A, 1B, 1C:
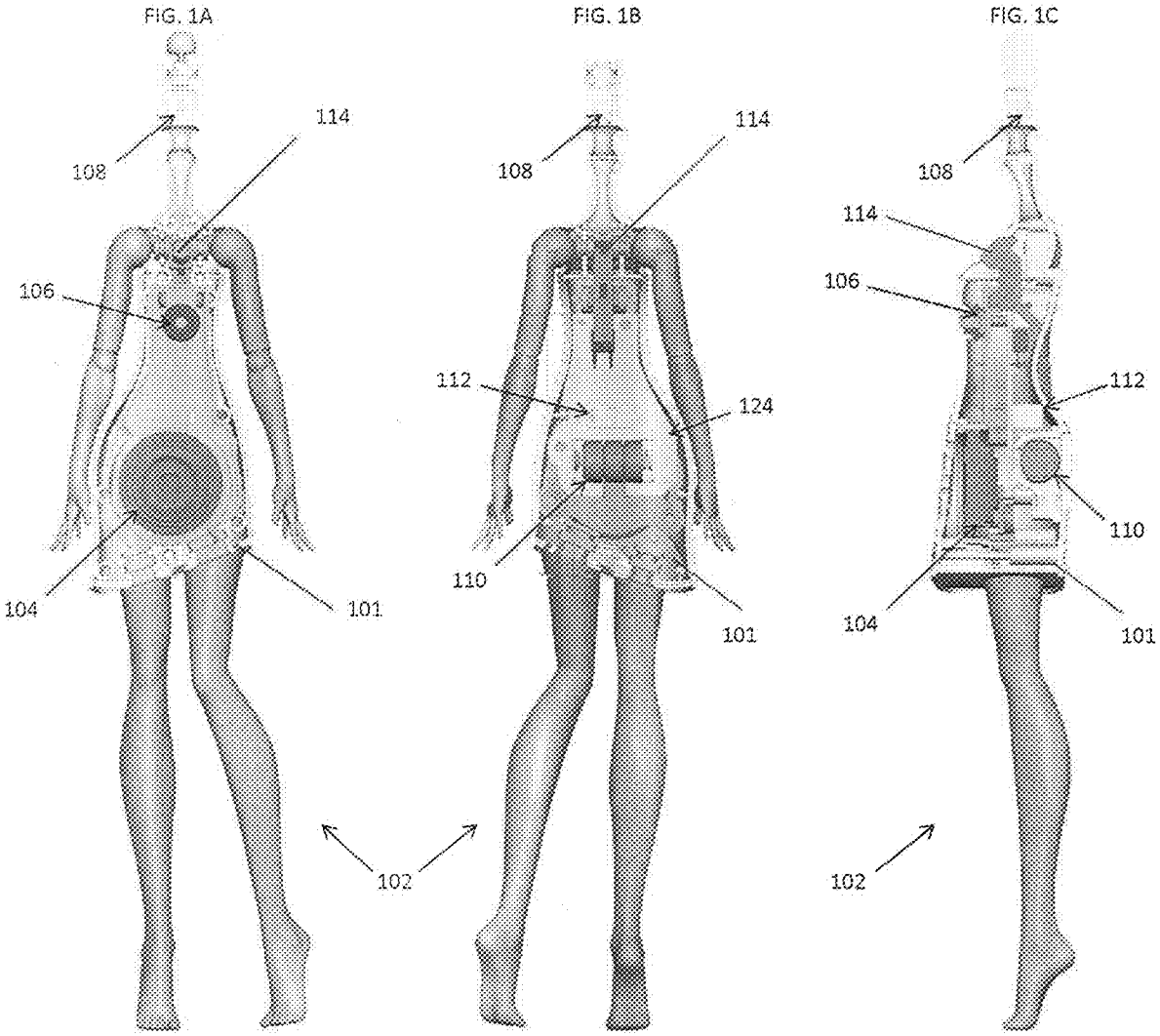
FIG. 1A is a front sectional-view of a toy figure, according to an example embodiment.
FIG. 1B is a back sectional-view of the toy figure of FIG. 1A.
FIG. 1C is a side sectional-view of the toy figure of FIG. 1A.

FIGS. 1A-1C are front, back, and side sectional views of a toy FIG. 102 in accordance with embodiments presented herein. FIGS. 1A-1C illustrate that the toy FIG. 102 comprises a body/structure 101 in which an audio output device/mechanism 104, a photosensor 106, a visual output device/mechanism 108, an activation switch 114, and an electronics assembly 124 are located. The audio output device 104 may comprise, for example, a transducer (speaker), while the visual output device 108 may comprise one or more light emitting diodes (LEDs). In one specific embodiment, the one or more LEDs comprise one white LED.

The battery 110 powers a circuit in the toy FIG. 102. The activation switch 114 may be, for example, an on/off button that allows a user to activate (i.e., turn on) one or more electronic components of the toy figure. The photosensor 106 is an electronic component that is configured to detect the presence of visible light, infrared (IR) transmission, and/or ultraviolet (UV) energy. For example, the photosensor 106 may be a passive light sensor (e.g., a phototransistor), an IR proximity sensor that emits an IR signal (e.g., a wide-angle IR signal) and measures the intensity of a reflected IR signal, or another type of device with photoconductivity properties.

The electronics assembly 124 includes a battery 110 and a microprocessor or microcontroller 112. As described further below, the microcontroller 112 is formed by one or more integrated circuits (ICs) and is configured to perform the methods and functions described herein. Also as described further below, the microcontroller 112 is selectably connected to the photosensor 106 via one or more of a plurality of input signal pathways. The photosensor 106 and the plurality of input signal pathways are sometimes collectively referred to herein as a photosensing circuit.

Figure 2:
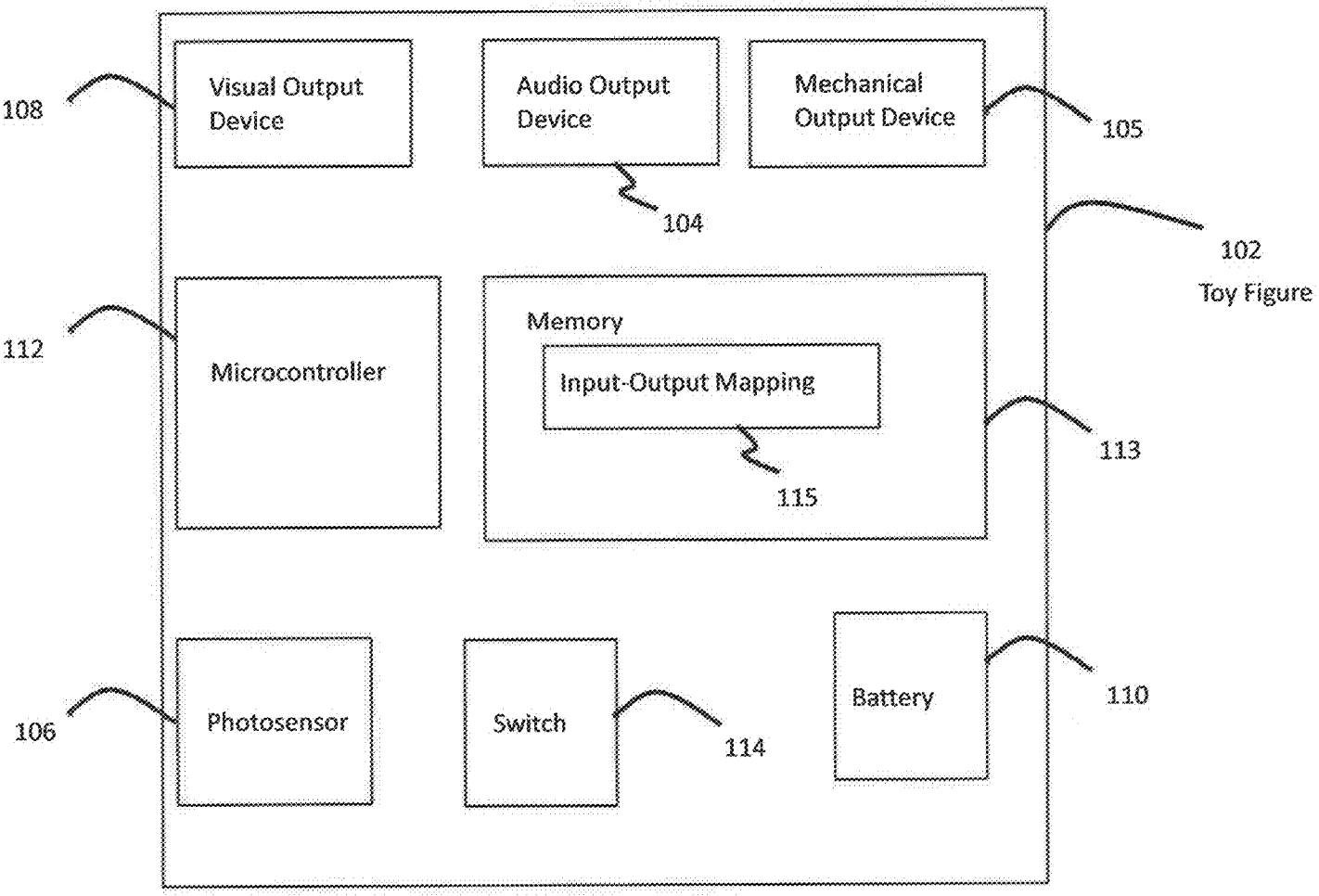
FIG. 2 is a block diagram of a toy figure, according to an example embodiment.

FIG. 2 is a block diagram illustrating further details of the toy FIG. 102 in accordance with certain embodiments presented herein. As noted above, the toy FIG. 102 comprises the photosensor 106, the activation switch 114, the battery 110, the microcontroller 112, the visual output device 108, and the audio output device 104. Also shown in FIG. 2 are a mechanical output mechanism/device 105 and a memory 113. The mechanical output device 105 is configured to generate mechanical motion of one or more components of the toy FIG. 102. The memory 113 includes, among other elements, one or more input-output (I/O) mappings 115. As described further below, the one or more I/O mappings 115 may be used by the microcontroller 112 to translate/map inputs received from the photosensor 106, which represent the proximity of an object to the toy FIG. 102, into outputs generated by one or more of the visual output device 108, the audio output device 104, or the mechanical output device 105.

That is, the toy FIG. 102 is configured to produce different (variable) audible, visual, and/or mechanical outputs based on the proximity of an object, such as the hand of a user (e.g., child), to the toy figure. For example, as a user places his/her hand closer to the toy figure, the toy FIG. 102 may emit different sounds and/or variations of light. In some embodiments, the different sounds include variations in pitch and/or volume level and the variations in light include differences in brightness/intensity and/or color of light. That is, movement of the hand towards and away from the toy figure causes changes in the pitch and brightness of light (e.g., the closer the hand is to the toy FIG. 102, the higher the pitch and/or brighter the light intensity). In other embodiments, the differences are presented as differences in sound/light patterns. For example, a sound pattern may be presented with different tempos and a light pattern may be presented with different flicker rates or different cycle speeds.

In one embodiment, the photosensor 106 is a passive ambient light sensor that sends either a digital value or voltage level to the microcontroller 112 that corresponds to the ambient light level on the sensor. The microcontroller 112 may then use the digital value/voltage level as an indicator for the distance between the sensor 106 and the object (i.e., the closer the user's hand, the "darker" the ambient light level). In an alternative embodiment, the photosensor 106 is an IR proximity sensor that emits an IR beam (e.g., wide-angle) and measures intensity of reflected IR light back. The microcontroller 112 then uses the intensity of reflected IR light as an indicator for the distance between the sensor and the object (i.e., the closer the child's hand, the "brighter" the reflected IR light levels). In some embodiments, the microcontroller 112 uses a proxy, such as average capacitive charge times, to gauge the proximity of an object.

Regardless of the type of photosensor 106 employed, the microcontroller 112 takes the data from the sensor and maps the proximity of the object (determined from the sensor level) to one of a number of different outputs, such as different outputs produced by the audio output device 104 (e.g., different sounds, different frequencies of one or more sounds, etc.), r different outputs produced by the visual output device 108 (e.g., different intensities, different colors or combinations of colors, etc.), and/or different outputs produced by the mechanical output device 105. Stated differently, the microcontroller 112 is configured to associate (i.e., classify/categorize) the proximity of the object with one or more one of a plurality of different proximity ranges each representing a discrete input state. The microcontroller 112 is configured to use the one or more I/O mappings 115 to map the proximity range in which the object is located to one of a plurality of different output states, which each cause the audio output device 104, the visual output device 108, and/or the mechanical output device 105 to produce different outputs (i.e., the microcontroller correlates the received signal with a discrete output state corresponding to the determined input state range). In one example, different proximities of the object, as indicated by different sensor levels, produce different musical tones.

As described further below, in certain embodiments, the mapping of proximities (i.e., input states) to outputs (i.e., output states) is determined dynamically and/or adaptively to accommodate changes in background/ambient lighting levels (e.g., from use-to-use or perhaps during a single use). That is, when the toy FIG. 102 is activated, the microcontroller 112 may automatically take a sensor reading to determine the level of the ambient lighting within the vicinity of the toy FIG. 102. This ambient light detection can be used to set a baseline or background lighting level against which the mapping may be calibrated.

Figures 3A, 3B, 3C:
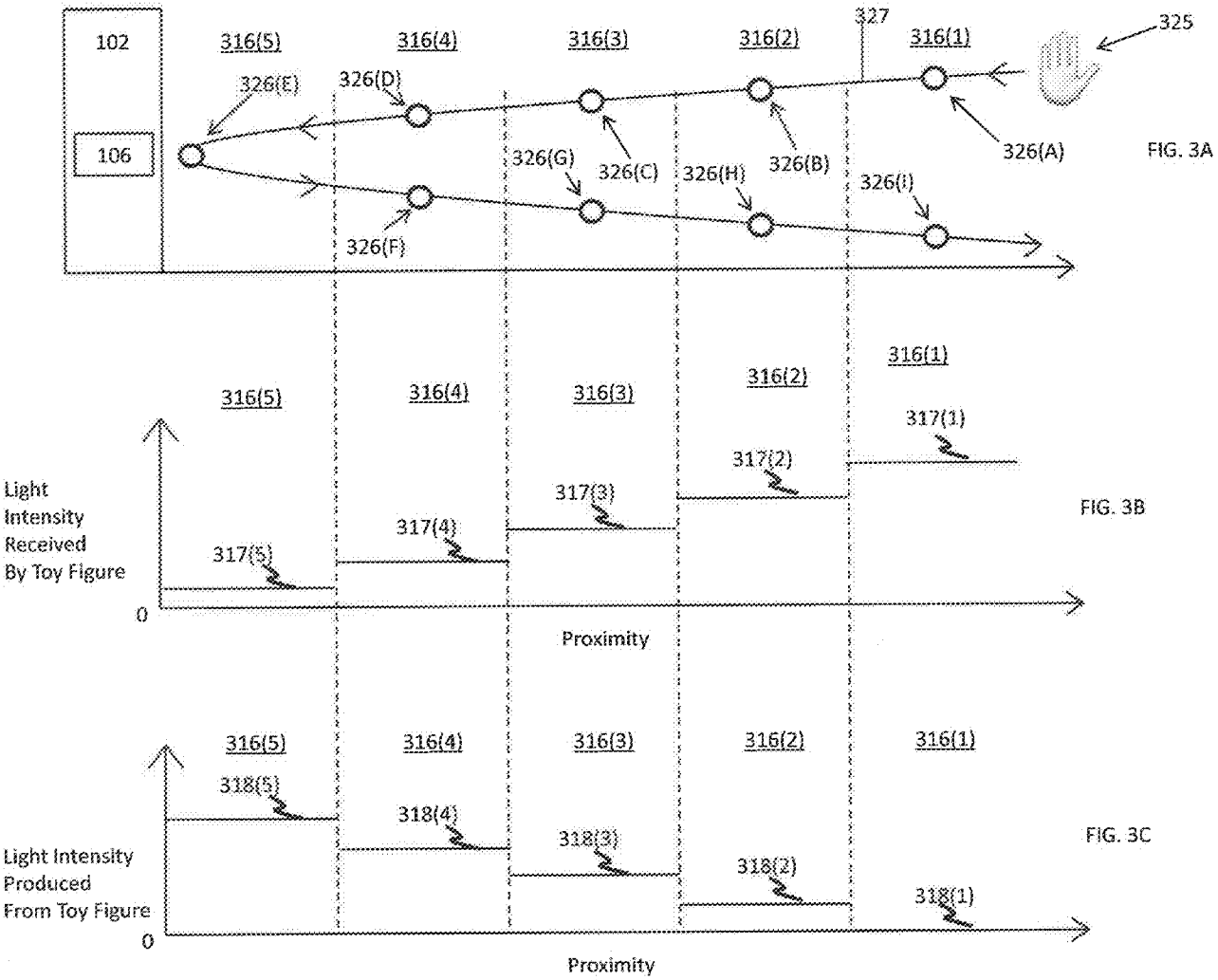
FIG. 3A is a diagram illustrating the proximity of an object to a toy figure, according to an example embodiment.
FIG. 3B is a plot illustrating variable light intensity received by a toy figure in response to the proximity of an object to the toy figure, according to an example embodiment.
FIG. 3C is a plot illustrating light intensity produced by a toy figure in response to the proximity of an object to the toy figure, according to an example embodiment.

FIG. 3A is an example diagram schematic illustrating the concept of proximity ranges adjacent to the toy FIG. 102 in which an object 325 (e.g., a child's hand) may be located/positioned. FIG. 3B is an example diagram illustrating how the light intensity received/sensed by the toy FIG. 102 changes as the proximity of the object 325 to the toy figure changes. FIG. 3C is an example diagram illustrating how changes in the proximity of the object 325 are used to control an output of the toy FIG. 102. For ease of illustration, FIG. 3C depicts a specific output change in the form of increasing light intensity produced by the toy FIG. 102 (i.e., visual output device 108) as the object 325 approaches the toy FIG. 102. Also for ease of illustration, FIGS. 3A, 3B, and 3C will be described together.

Shown in FIGS. 3A-3C are five (5) proximity ranges 316(1)-316(5), with proximity range 316(5) being the spatial region immediately adjacent to the toy FIG. 102 and proximity range 316(1) being the farthest spatial region within a vicinity of the toy figure. FIG. 3A illustrates nine (9) example positions/locations, referred to as locations 326(A)-326(I), for object 325 within the vicinity of the toy FIG. 102. FIG. 3A also includes a curve 327 illustrating the trajectory of object 325 as the object moves sequentially through the nine positions.

Initially, object 325 is located at position 326(A), which is in proximity range 316(1). In this proximity range 316(1), the photosensor 106 receives/senses a light intensity level 317(1). As noted above, one or more inputs from the photosensor 106, which represent the received light intensity level 317(1), are used by the microcontroller 112 to determine the proximity range of the object 325. As shown in FIG. 3C, when the microcontroller 112 determines that the object 325 is located within proximity range 316(1), the microcontroller 112 sends a signal to the visual output device 108 to produce a light with a first intensity level 318(1) of zero and/or does not send a signal to activate the visual output device 108 (i.e., the visual output device 108 is turned off or remains off).

Subsequently, the object 325 moves to position 326(B) so that the object is within proximity region 316(2), where the photosensor 106 receives a light intensity level 317(2). Again, as noted above, the photosensor 106 converts the light intensity level 317(2) into one or more inputs that are provided to the microcontroller 112. The microcontroller 112 then determines that the object is within proximity region 316(2) based on the one or more inputs from the photosensor 106. As shown in FIG. 3C, when the microcontroller 112 determines that the object 325 is located within proximity range 316(2), the microcontroller 112 instructs the visual output device 108 to generate light with a second intensity level 318(2). As long as the object 325 remains within the proximity region 316(2), the microcontroller 112 signals the visual output device 108 to continue to generate light at this second intensity level 318(2).

In the example of FIGS. 3A and 3B, the object 325 next moves to position 326(C) and then to position 326(D) located in proximity ranges 316(3) and 316(4), respectively. As shown in FIG. 2C, when the microcontroller 112 determines that the object 325 is located within each of these proximity ranges 316(3) and 316(4) (based on light intensity levels 317(3) and 327(4) received by the photosensor 106), the microcontroller 112 instructs the visual output device 108 to generate light with a third intensity level 318(3) (i.e., while in proximity range 316(3)) and then a fourth intensity level 318(4) (i.e., while in proximity range 316(4)).

After position 326(D), the object 325 moves to position 326(E), which is within the closest proximity range 316(5). As shown in FIG. 3C, when the object 325 is determined to be located within proximity range 316(5) (based on light intensity level 317(5) received by the photosensor 106), the microcontroller 112 instructs the visual output device 108 to generate light with a fifth intensity level 318(5). Since the proximity range 316(5) is the closest spatial region to toy FIG. 102, the fifth intensity level 318(5) is the most intense light generated by the visual output device 108 based on the proximity of the object 325 to the toy figure. As noted, as long as the object 325 remains within the proximity region 316(5), the microcontroller 112 instructs the visual output device 108 to continue to generate light at this fifth intensity level 318(5).

As shown by the trajectory curve 327 of the object 325, positions 326(A)-326(E) are all encountered as the object 325 is moved towards the toy FIG. 102. As shown in FIG. 3B, the intensity of the light received by the photosensor 106 successively decreases, in steps, as the object 325 moves through positions 326(A)-326(E) (i.e., towards the toy FIG. 102). However, as shown in FIG. 3C, as the object 325 moves through positions 326(A)-326(E), the intensity of the light produced by the visual output device 108 increases, in steps, until it reaches the max intensity within proximity range 316(5).

In the examples of FIGS. 3A-3C, after reaching position 326(E), the object 325 is then moved away from the toy FIG. 102. During this second portion of the trajectory curve 327, the object 325 is located successively at positions 326(F), 326(G), 326(H), and then 326(I) within proximity ranges 316(4), 316(3), 316(2), and 316(1), respectively. As shown in FIG. 3B, the intensity of the light received by the photosensor successively increases, in steps, as the object 325 is moved away from the toy FIG. 102. However, as shown in FIG. 3C, the intensity of the light produced by visual output device 108 successively decreases, in steps, as the object 325 is moved away from the toy FIG. 102.

In summary, FIGS. 3A-3C illustrate that the microcontroller 112 is configured to use inputs from the photosensor 106 to determine the proximity of the object 325 to the toy FIG. 102 based on the intensity of the light received by the photosensor 106. The proximity of the object 325 to the toy FIG. 102 is classified/categorized as falling into one of the plurality of different proximity ranges 316(1)-316(5). The proximity range 316(1)-316(5) in which the object 325 is located is then mapped to one or more light intensities for visual output device 108. As such, the intensity of the visual output device 108 increases or decreases in steps as the object 325 moves closer to or farther from, respectively, the toy FIG. 102.

FIGS. 3A-3C illustrate a specific example in which there are five proximity ranges. It is to be appreciated that the use of five proximity ranges is merely illustrative and that other embodiments may make use of a greater or fewer number of proximity ranges. Additionally, FIGS. 3A-3C illustrate a specific example where the output that is varied is an intensity of the visual output device 108. Again, it is to be appreciated that varying the intensity of the visual output device 108 is merely one example of the type of an output that can be adjusted in accordance with embodiments presented herein. As mentioned above, other outputs include variations in pitch, frequency, tone, and/or volume level of sound produced by an audio output source 104, variations in color of light produced by the visual output device 108, variations in tempo or frequency of sound and/or light patterns, motion generated by the mechanical output device 105, etc. In addition, the toy FIG. 102 may emit multiple outputs simultaneously, and these multiple outputs may each be adjusted based on the proximity of an object is within the scope of the embodiments presented herein. For instance, the microcontroller 112 may adjust the light intensity, audio volume, and/or audio frequency in various combinations.

Figure 4:
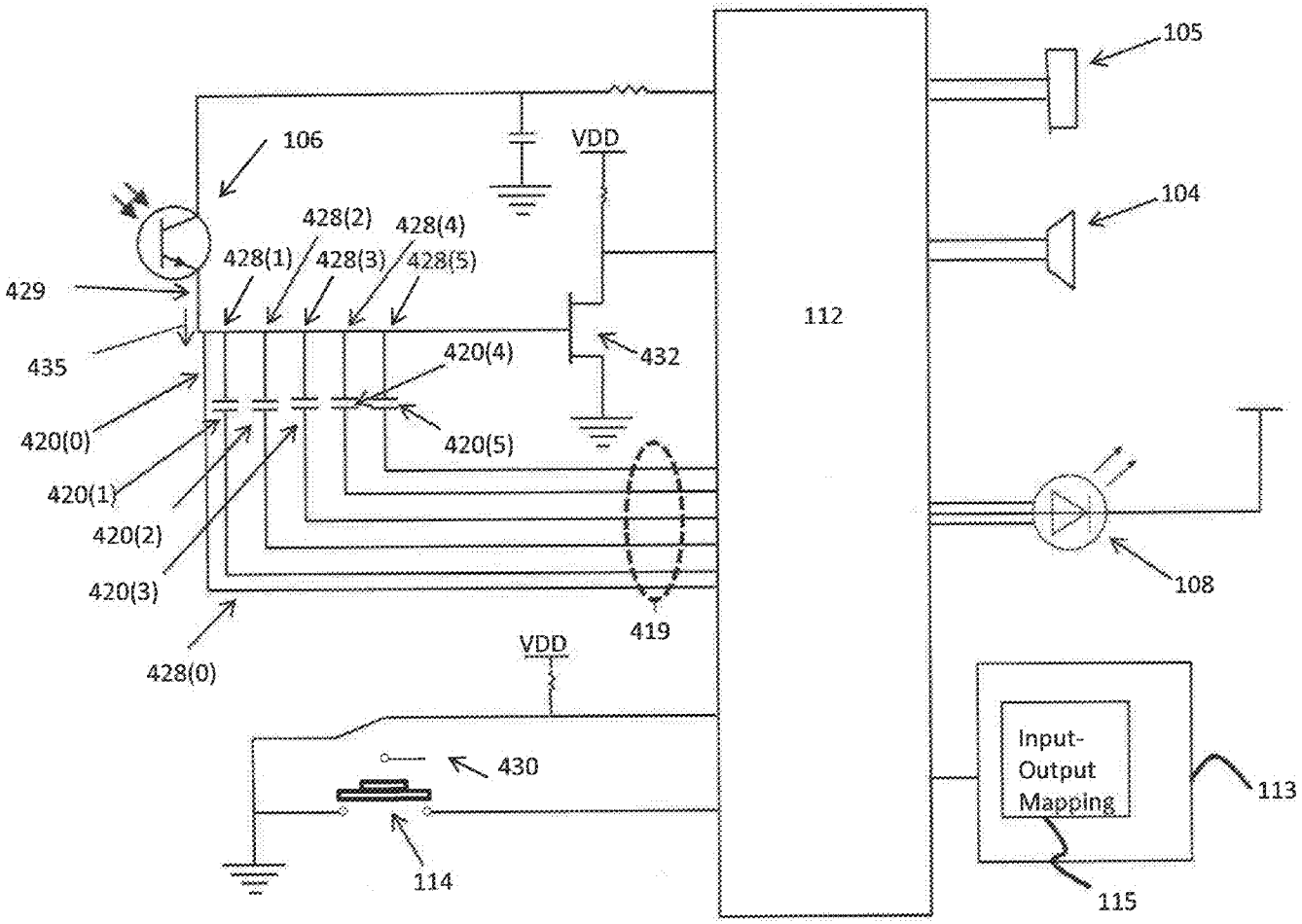
FIG. 4 is a circuit diagram of a toy figure, according to an example embodiment.

FIG. 4 is a simplified schematic circuit diagram enabling a toy figure, such as toy FIG. 102, to generate variable outputs in response to the proximity of an object to the toy figure, in accordance with examples presented herein. FIG. 4 illustrates, in a schematic format, the photosensor 106, the microcontroller 112, the sound output device 104, and the visual output device 108, each of which have been described above. FIG. 4 illustrates in block format the mechanical output device 105 and the memory 113. Also shown in FIG. 4 is a plurality 419 of input signal pathways 428(0)-428(5) that are connected in parallel between an output 429 of the photosensor 106 and the microcontroller 112. Each of the input signal pathways 428(0)-428(5) includes a respective capacitance value 420(0)-420(5), which may be formed by an inherent capacitance or an in-line capacitor. For ease of illustration, the capacitance values 420(1)-420(5) are generally described as being formed by respective capacitors each having unique (i.e., different) associated capacitances. The capacitance value 420(0) refers to a stray capacitance on the input pathway 428(0) between the output 429 of the photosensor 106 and the microcontroller 112. In certain examples, this stray capacitance 420(0) on the input pathway 428 is referred to herein as a "capacitor."

In one example, the capacitors 420(0)-420(5) form a programmable gain controller (PGC) which produces outputs that are provided on the one or more of the input pathways 428(0)-428(5) to the microcontroller 112. As noted above, the photosensor 106 and the plurality of input signal pathways 419 (including capacitors 420(0)-420(5)) are sometimes collectively referred to herein as a photosensing circuit.

As noted above, the photosensor 106 is configured to convert incoming light into one or more input signals that are provided to the microcontroller 112. These input signals, which are generally represented in FIG. 4 by arrow 435, are transmitted over a selected one of the input signal pathways 428(0)-428(5) to the microcontroller 112. As described above, the microcontroller 112 is configured to determine, from the one or more input signals 435, a proximity of an object to the toy FIG. 102. The microcontroller 112 is further configured to map this proximity to a corresponding output generated by one or more of the audio output device 104, the visual output device 108, the mechanical output device 105, or other output device/mechanism.

In an embodiment, the toy FIG. 102 includes five modes, some of which utilize the interactive proximity techniques. In a "Warmup Mode," the toy FIG. 102 is configured to generate successively higher pitched notes as an object nears the toy figure. In this Warmup Mode, the microcontroller 112 is configured to determine whether the object is located within one of five proximity ranges and to map each of these five proximity ranges to one of five outputs (output states). Four of the five outputs correspond to four different frequencies of an audio signal and/or four different sound files, while the fifth output corresponds to an "off" setting. In the Warmup Mode, an intensity of light produced by the visual output source 108 may also vary in a similar manner based on the proximity of the object to the toy FIG. 102.

In a "Rehearsal Mode," one or more background audio tracks are looped several times (e.g., two times for a total of 32 seconds). In this mode, the microcontroller 112 adjusts the volume of an overlaid vocal track based on the proximity of an object to the toy FIG. 102. For example, as the object approaches the toy FIG. 102, the louder the volume of the overlaid vocal track becomes. In the Rehearsal Mode, the microcontroller 112 is configured to determine whether the object is located within one of eight proximity ranges and to map each of these eight proximity ranges to one of eight outputs. Seven of the eight outputs correspond to seven different volume levels, while the eighth output corresponds to an "off" setting. In the Rehearsal Mode, an intensity of light produced by the visual output source 108 may also vary in a similar manner based on the proximity of the object to the toy FIG. 102.

The toy FIG. 102 also includes a "Try-Me Mode" which is similar to the Rehearsal Mode, but only lasts for a shorter time period (e.g., 5 seconds). This Try-Me Mode is determined by the presence or absence of a try-me pull tape switch 430. As explained in greater detail below, the Try-Me Mode may use a calibration routine that is different from a calibration routine used on the Rehearsal Mode.

The toy FIG. 102 may also include a "Performance Mode" and a "Lights Only Mode." The Performance Mode, which lasts for a short time period (e.g., 16 seconds), involves the toy FIG. 102 playing sounds and lights regardless of a proximity of an object to the toy figure. The Lights Only Mode, which lasts for a different longer period (e.g., 30 seconds), modulates the intensity/brightness of the visual output source 108 regardless of a proximity of an object to the toy figure.

Further details of the operation of the proximity sensing operations are now described below with reference to FIG. 4. In certain embodiments, the photosensor 106 is a visible light shadow detector. The photosensor 106 is a phototransistor that approximates an ideal current source for a given light L. A fixed current (I) into a capacitor of value C specifies a relatively linear charge time (dt) of voltage (dV) specified by the function:

$$I=C*dV/dt,$$

where I is the current through the photosensor 106, C is the capacitor value, dV is the total voltage rise until logic switch, and dt is the charge-up time.

In certain examples, the charge-up time may be measured, for example, as a 12-bit value by a polling loop. The loop may be 15 instructions long, or 3.75 microseconds, and may time out at value 0xB00, or 10.6 milliseconds. The capacitors 420(1)-420(5) may be buffered by a field-effect transistor 432 (e.g., a 2N7002 MOSFET) in order to stabilize the charge-up time for a given light level over the battery voltage. As described further below, the capacitor used for the determination (e.g., one of capacitors 420(1)-420(5)) is selected based on the ambient light (i.e., the amount of light in the environment in which the toy FIG. 102 is located). Input/Output (I/O) pins controlling unused (non-selected) capacitors may be set to "float" to minimize their capacitive effect. Stated differently, the microcontroller 112 is selectably connected to the photosensor 106 via the plurality of input signal pathways 419 such that only one input signal pathway is active (i.e., used to relay the photosensor signals to the microcontroller) during sensing operations. As a result, the non-selected input signal pathways 419 are disconnected (i.e., floating) during sensing operations.

By switching the I/O pins of the microcontroller 112 connected to each capacitor 420(0)-420(5) from a value of zero (0) to float, the microcontroller 112 can switch each unused capacitor off and effectively vary C. For a given load of R, the MOSFET 432 in a common-source circuit will consume no gate current and will switch at a specific voltage.

The microcontroller 112 can determine the current through the photosensor 106 using the following process. First, an I/O pin is used by the microcontroller 112 to switch the gate of the MOSFET 432 to 0V via input pathway 428(0), forcing the gate-to-source voltage (Vgs) of the MOSFET 432 to 0V. Next, the microcontroller sets the I/O pin at input pathway 428(0) to "float," sets the I/O pin for the selected input pathway to 0V, and starts a timer. The gate to source voltage rises due to the phototransistor current. The microcontroller 112 then records the time when the MOSFET 432 switches. Given the currently enabled PGC capacitor (i.e., which of the capacitors 420(0)-420(5) is selected), the switching time informs the microcontroller 112 of the intensity of the received light (L). If the reading is saturated (e.g., too dark/charge time too long, or too bright/charge time too short), then a different PGC capacitor can be selected and the process can be repeated.

A calibration routine may be utilized to set a baseline reading (i.e., the ambient light reading, referred to herein as "BASE") for the interactive proximity feature, as well as to calculate thresholds for proximity ranges (e.g., proximity ranges 316(1)-316(5)). During the calibration routine, the microcontroller 112 calibrates to the ambient light level, including calculating a reading DELTA between positions given the current mode.

Table 1 provides example photosensor currents for a respective capacitor which may correspond to capacitors 420(0)-420(5) in FIG. 4. In the example illustrated in Table 1, the baseline charge-up value may be in the range of 0x100-0x800, which represents the amount of time it takes to charge up the capacitor. As shown, there is a considerable overlap in the usable ranges to allow for any variance in capacitor values. In general, the lower the capacitive value, the darker the ambient light that is detected by the microcontroller 112.

| # | Capacitor Value | Current at 0x100 (uA) | Current at 0x800 (uA) |
|---|---|---|---|
| 0 | None (470 pF stray capacitance) | 0.73 | 0.09 |
| 1 | 2200 pF | 3.44 | 0.43 |
| 2 | 6800 pF | 10.63 | 1.33 |
| 3 | 0.022 uF | 34.38 | 4.30 |
| 4 | 0.068 uF | 106.25 | 13.28 |
| 5 | 0.22 uF | 343.75 | 42.97 |
| 6 | All caps in parallel (0.33 uF) | 515.63 | 64.45 |

The above table illustrates an example in which there are six (6) different input signal pathways, each having a different associated capacitance value, which may be used to receive signals from the photosensor 106 (i.e., different capacitance values that may be used to sense the current through the photosensor). The microcontroller 112 is configured to execute a calibration routine to determine which of the input signal pathways (i.e., which capacitance value) should be activated at any given time. The calibration routine sets the baseline reading (i.e. the ambient light reading or BASE) for the interactivity feature, as well as sets up the thresholds for each of the proximity steps. The calibration routine may be triggered by a number of different events, such as when the toy figure enters one of the Warmup Mode, the Rehearsal Mode, or the Try-Me Mode, the microcontroller 112 obtains a photosensor reading (TIME) that is less than the current baseline reading (i.e., TIME<BASE), when the microcontroller 112 selects a new input signal pathway, a user input, etc.

For example, a calibration procedure may be invoked when a user presses an activation switch 114 on the toy FIG. 102. In response, the microcontroller 112 sets BASE=TIME. As the user withdraws his/her hand (from pressing the switch 114), the shadow cast by the hand recedes, causing the photosensor 106 to obtain readings in which TIME<BASE (i.e. the time it takes to charge a capacitor is less than the baseline time it takes to charge the same capacitor). This condition triggers recalibrations with each reading. When the shadow cast by the hand has receded sufficiently, the microcontroller 112 calibrates to the ambient light, which is no longer blocked by the user's hand. If the current read from the photosensor 106, as represented by the time it takes to charge a selected capacitor, becomes too low or too high, a new capacitor (e.g., one of capacitance values 420(0)-420(5)) may be selected, and the calibration process may be restarted.

As noted above, the microcontroller 112 is configured to sense the proximity of an object within various proximity steps/range (e.g., proximity ranges 316(1)-316(5)). The width of each of these proximity ranges may vary linearly with the baseline value (BASE), and is given by the value DELTA. DELTA is calculated in the calibration routine. In one example, the Warmup Mode utilizes five proximity ranges and DELTA is calculated as DELTA=BASE>>3, where ">>" represents an arithmetic right bitwise shift and the number following represents the number of places the value before the ">>" is shifted. The Rehearsal Mode may utilize eight proximity steps, and DELTA is calculated instead as DELTA=BASE>>4. In addition, some hysteresis may be added to the system in order to prevent rapid switching at the step thresholds. This hysteresis may be calculated as HYST=DELTA>>2.

After calibration, if the baseline ambient light reading (BASE) is less than 0x100 or greater than 0x800 (i.e., outside the baseline charge-up value for the selected capacitor), then the microcontroller 112 automatically selects a new charge up capacitor (i.e., select a new input signal pathway) and attempts recalibration after a short timeout. The calibration routine is then automatically restarted. If the new capacitor still gives a baseline reading that is too low or too high, then the routine repeats until either a suitable value is found or the lowest/highest capacitor value is reached (e.g., the lowest/highest capacitor value from Table 1). This calibration routine allows the proximity detection system to work properly in a wide range of ambient light environments.

To facilitate operation in, for example, environments that include halogen lamps on dimmers or fluorescent lamps with inductor ballasts, an averaging system is provided to stabilize the output in situations involving low frequency modulated light (e.g., 60 Hz). In one example, an averaging system uses a 16-bit running sum (SIGMA) of all of the previous readings to store the average light level (AVG_TIME). To calculate the average, the following calculation is performed after each photosensor reading:

SIGMA=SIGMA−AVG_TIME+TIME

AVG_TIME=SIGMA>>4

The AVG_TIME is then used for subsequent proximity calculations.

After the baseline value has been established (BASE), and the sensor input has been sensed and averaged (AVG_TIME), BASE and AVG_TIME may be compared so that the proximity level can be ascertained in steps (QUOT) of length DELTA. This is accomplished by the following calculation: QUOT=(AVG_TIME−BASE)/DELTA. QUOT is generally positive. If QUOT is negative, then a recalibration is triggered. QUOT may be hard limited by 0<=QUOT<=4 for Warmup Mode or 0<=QUOT<=7 for Rehearsal Mode.

In an embodiment, the toy figure outputs a light signal, such as one white LED. Light from the light signal may affect sensor readings, especially in darker ambient environments. For this reason, the LED may be turned off for a "blanking period" when the photosensor 106 is taking a reading. It is helpful that any given blanking period be sufficiently short, so as to avoid user perception or detection.

In accordance with examples presented herein, once the photosensor 106 has finished taking a reading, the data is processed in the following manner to translate this reading into the various positions used by the toy FIG. 102. First, the firmware calibrates to the current ambient light level, including calculating the reading delta between positions given the current mode. The firmware tries various charge-up capacitors until it detects an ambient light level in the usable range (0x100-0x800). After a new capacitor is selected, calibration is triggered again. In addition, the firmware averages the readings to prevent strange behavior and false triggers under ambient light. The firmware then compares the current reading against the ambient light level and updates the proximity position.

As noted above, in accordance with the techniques presented herein, the microcontroller 112 is configured to utilize one or more I/O mappings 115 of a plurality of sequential ranges of input states (i.e., proximity ranges) to a plurality of discrete output states to generate variable outputs. That is, the microcontroller 112 receives an input signal from the photosensor 106 through at least one input signal pathway 419. The microcontroller 112 then determines that the input signal falls within one of the ranges of input states. Using the one or more I/O mappings 115, the microcontroller 112 correlates the input state range in which the input signal falls with a selected one of the plurality of discrete output states and then produces an output signal corresponding to the selected output state. An output mechanism, such as visual output device 108, audio output device 104, and/or mechanical output device 105, receives the output signal from the microcontroller 112 and generates an output corresponding to the selected output state.

Two modes in which the one or more I/O mappings are utilized are the above-described "Warmup Mode" and the above-described "Rehearsal Mode." While in the Warmup Mode, the mapping can be given as:

QUOT=0: LED off (PD=0xF), and toggle MAJOR or MINOR key

QUOT=1: LED at level 1 (PD=0xE); Play note01_db.wav

QUOT=2: LED at level 2 (PD=0xD); Play note03_f.wav

QUOT=3: LED at level 4 (PD=0xB);

If MAJOR key: Play note05_ab.wav

Else MINOR key: Play note06_bb.wav

QUOT=4: LED at level 7 (PD=0x8); Play note08_db.wav

In the above example, "QUOT" is the input state, and the LED levels and the associated keys/notes are the output states.

While in the Rehearsal mode, the mapping can be given as:

QUOT=0: LED off (PD=0xF), Channel 0 volume at 0 (off)

QUOT=1: LED at level 1 (PD=0xE); Channel 0 volume at 1

QUOT=2: LED at level 2 (PD=0xD); Channel 0 volume at 2

QUOT=3: LED at level 3 (PD=0xC); Channel 0 volume at 3

QUOT=4: LED at level 4 (PD=0xB); Channel 0 volume at 4

QUOT=5: LED at level 5 (PD=0xA); Channel 0 volume at 5

QUOT=6: LED at level 6 (PD=0x9); Channel 0 volume at 6

QUOT=7: LED at level 7 (PD=0x8); Channel 0 volume at 7 (max)

In the above example, "QUOT" is the input state, and the LED levels and associated volumes are the output states.

Figure 5:
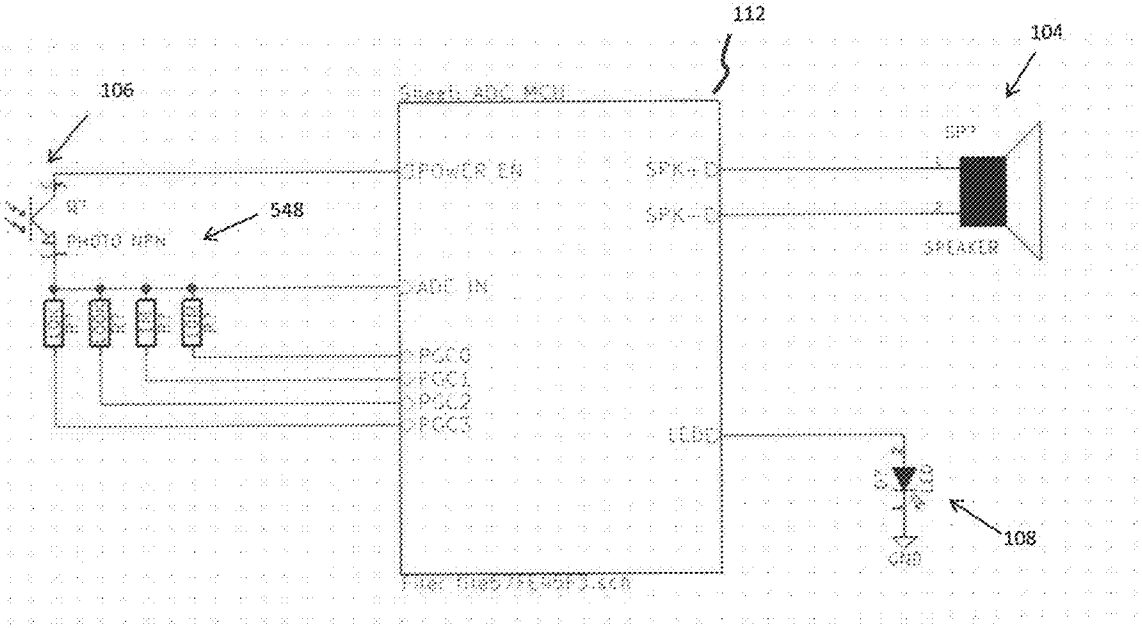
FIG. 5 is a circuit diagram of a toy figure, according to another example embodiment.

The above examples have been primarily described herein with reference to the use of current-based measurements to detect the proximity of an object to a toy figure. It is to be appreciated that alternative embodiments may make use of voltage-based measurements to detect the proximity of an object to a toy figure. For example, FIG. 5 is a simplified schematic diagram illustrating an arrangement in which the array of capacitors 420(0)-420(5) described in FIG. 4 is replaced by an array 548 of resistors that each has a different associated resistance. Similar to the above embodiments, the microcontroller 112 is configured to receive input signals from one or more of the resistors within the array 548 and to determine the proximity of an object based on these input signals. The microcontroller 112 can then map, using one or more IO mappings (not shown in FIG. 5), the determined proximity of the object to one or more outputs that can be produced by the visual output device 108, the audio output device 104, and/or another output device/mechanism.

Figure 6:
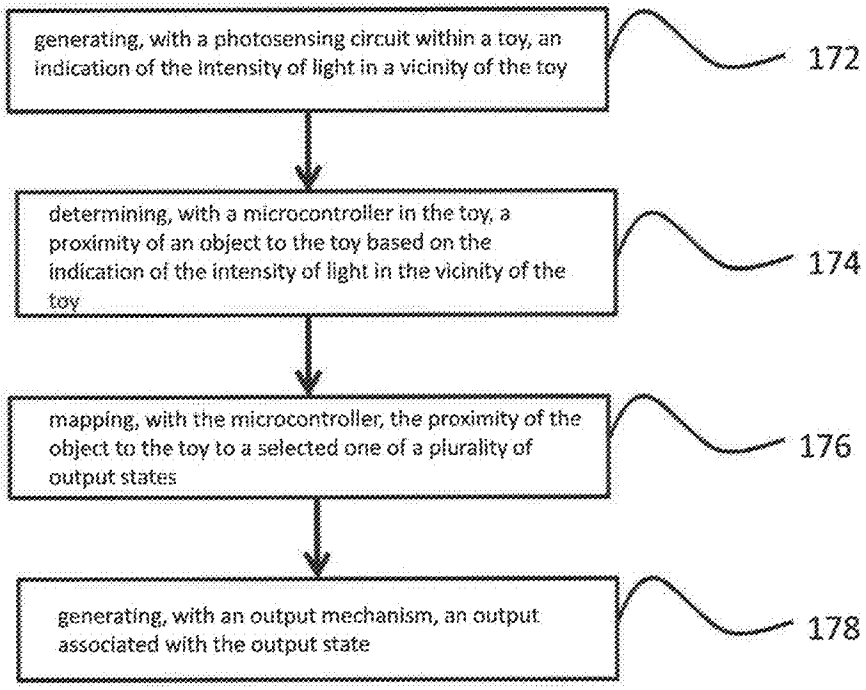
FIG. 6 is a flowchart of a method, according to an example embodiment.

FIG. 6 is a flowchart of a method 170 in accordance with embodiments presented herein. Method 170 begins at 172 where a photosensing circuit within a toy generates an indication of the intensity of light in a vicinity of the toy. At 174, a microcontroller in the toy determines proximity of an object to the toy based on the indication of the intensity of light in the vicinity of the toy. At 176, the microcontroller maps the proximity of the object to the toy to a selected one of a plurality of output states. At 178, an output mechanism generates an output associated with the output state.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

What is claimed is:

1. A toy comprising: a photosensor;

a memory comprising at least one mapping of a plurality of sequential ranges of input states to a plurality of discrete output states;

at least one input signal pathway operably connected to the photosensor;

a microprocessor operably connected to the photosensor through a plurality of input signal pathways, the microprocessor operable to:

select one of the input signal pathways as an active signal pathway, receive an input signal from the photosensor through only the active signal pathway, determine that the input signal falls within one of the ranges of input states, use the at least one mapping to correlate the input state range in which the input signal falls with a selected one of the plurality of discrete output states; and produce an output signal corresponding to the selected output state; and an output mechanism configured to receive the output signal from the microprocessor and to generate an output corresponding to the selected output state; wherein the memory, the at least one input signal pathway, and the microprocessor are all within the toy.

2. The toy of claim 1, wherein the microprocessor is operable to select one of the input signal pathways as an active signal pathway based on an ambient light in a vicinity of the toy.

3. The toy of claim 1, wherein each of the input signal pathways has an associated capacitance that is different from the associated capacitance of each of the other input signal pathways.

4. The toy of claim 1, wherein the output mechanism is operable to produce at least two distinct outputs, each of the at least two distinct outputs corresponding to one of the discrete output states.

5. The toy of claim 1, wherein the output mechanism comprises at least one light emitting diode, and wherein the plurality of discrete output states comprises a plurality of different intensities of light.

6. The toy of claim 1, wherein the output mechanism comprises a speaker, and wherein the plurality of discrete output states comprises a plurality of different frequencies of an audio signal.

7. The toy of claim 1, wherein the photosensor is a passive light sensor.

8. The toy of claim 1, wherein the photosensor is an infrared sensor.

9. A method, comprising:

generating, with a photosensing circuit comprising a photosensor within a toy, an indication of an intensity of light in a vicinity of the toy;

determining, with a microcontroller in the toy, a proximity of an object to the toy based on the indication of the intensity of light in the vicinity of the toy, wherein the microcontroller is selectably connected to the photosensor via one or more of a plurality of input signal pathways, and wherein determining comprises:

selecting, with the microcontroller, one of the input signal pathways as a selected input signal pathway;

disabling, with the microcontroller, other of the plurality of input signal pathways; and receiving, at the microcontroller, an input signal from the photosensor via the selected one of the input signal pathways, where the input signal indicates the intensity of light in the vicinity of the toy;

mapping, with the microcontroller, the proximity of the object to the toy to a selected one of a plurality of output states; and generating, with an output mechanism, an output associated with the selected one of the plurality of output states.

10. The method of claim 9, wherein selecting one of the input signal pathways as a selected input pathway comprises:

selecting the selected one of the input signal pathways based on an ambient light in the vicinity of the toy.

11. The method of claim 9, further comprising:

determining, with the microcontroller, a first proximity of an object to the toy;

mapping, with the microcontroller, the first proximity of the object corresponding to a first output state;

generating, with the output mechanism, a first output corresponding to the first output state;

determining, with the microcontroller, a second proximity of the object to the toy;

mapping, with the microcontroller, the second proximity of the object to a second output state; and generating, with the output mechanism, a second output corresponding to the second output state.

12. The method of claim 11, wherein generating, with the output mechanism, the first output corresponding to the first output state comprises:

generating a first light output, and wherein generating, with the output mechanism, a second output corresponding to the second output state includes generating a second light output that is different from the first light output.

13. The method of claim 11, wherein generating, with the output mechanism, the first output corresponding to the first output state comprises:

generating a first audio output, and wherein generating, with the output mechanism, a second output corresponding to the second output state includes generating a second audio output that is different from the first audio output.

14. The method of claim 9, wherein the photosensor is a passive light sensor.

15. The method of claim 9, wherein the photosensor is an infrared sensor.

16. A toy, comprising:

a photosensing circuit comprising a photosensor configured to generate an indication of the intensity of light in a vicinity of the toy;

a microcontroller configured to determine a proximity of an object to the toy based on the indication of the intensity of light in the vicinity of the toy, and to map the proximity of the object to the toy to a selected one of a plurality of output states, wherein the microcontroller is selectably connected to the photosensor via one or more of a plurality of input signal pathways, and wherein to determine a proximity of an object to the toy, the microcontroller is configured to:

select one of the input signal pathways as a selected input pathway;

disable other of the plurality of input signal pathways; and receive an input signal from the photosensor via the selected one of the input signal pathways, where the input signal indicates the intensity of light in the vicinity of the toy; and an output mechanism configured to generate an output associated with the selected one of the plurality of output states.

17. The toy of claim 16, wherein to select one of the input signal pathways as a selected input pathway, the microcontroller is configured to:

select the selected one of the input signal pathways based on an ambient light in the vicinity of the toy.

18. The toy of claim 16, wherein the photosensor is at least one of a passive light sensor or an infrared sensor.

19. The toy of claim 1, wherein the microprocessor is further operable to:

disable other of the plurality of input signal pathways.

20. The method of claim 9, wherein each of the input signal pathways has an associated capacitance that is different from the associated capacitance of each of the other input signal pathways.

* * * * *